US008701564B2

(12) United States Patent
Schaller et al.

(10) Patent No.: US 8,701,564 B2
(45) Date of Patent: Apr. 22, 2014

(54) SELF-STEERING RADIAL BOGIE

(75) Inventors: Hans-Dieter Schaller, LaGrange, IL (US); Xiaoying Ma, Burr Ridge, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 685 days.

(21) Appl. No.: 12/504,516

(22) Filed: Jul. 16, 2009

(65) Prior Publication Data

US 2010/0011984 A1 Jan. 21, 2010

Related U.S. Application Data

(60) Provisional application No. 61/081,237, filed on Jul. 16, 2008.

(51) Int. Cl.
*B61D 1/00* (2006.01)

(52) U.S. Cl.
USPC ..... 105/168

(58) Field of Classification Search
USPC ..... 105/157.1, 159, 164–168, 171, 182.1, 105/185, 188, 194, 195; 411/531, 542, 546
See application file for complete search history.

(56) References Cited

U.S. PATENT DOCUMENTS

| | | | | |
|---|---|---|---|---|
| 4,067,261 | A | 1/1978 | Scheffel | |
| 4,067,262 | A | 1/1978 | Scheffel | |
| 4,151,801 | A | 5/1979 | Scheffel et al. | |
| 4,294,482 | A | 10/1981 | Scheffel et al. | |
| 4,300,454 | A | 11/1981 | Scheffel | |
| 4,480,553 | A | 11/1984 | Scheffel | |
| 4,628,824 | A * | 12/1986 | Goding et al. | 105/168 |
| 4,679,506 | A * | 7/1987 | Goding et al. | 105/136 |
| 4,735,149 | A | 4/1988 | Scheffel et al. | |
| 4,765,250 | A * | 8/1988 | Goding | 105/166 |
| 4,841,873 | A * | 6/1989 | Goding et al. | 105/168 |
| 5,588,367 | A | 12/1996 | Scheffel | |
| 5,746,134 | A * | 5/1998 | Scheffel | 105/168 |
| 5,746,135 | A * | 5/1998 | Ahmadian et al. | 105/196 |
| 6,006,674 | A | 12/1999 | Ahmadian et al. | |
| 6,439,130 | B1 | 8/2002 | Scheffel | |
| 6,745,700 | B2 | 6/2004 | Ma et al. | |
| 6,871,598 | B2 * | 3/2005 | Schaller et al. | 105/168 |

OTHER PUBLICATIONS

German publication describing SLM "Schwenkschiebelagerantrieb" bogie (2 pages).
German publication describing SLM "Schwenkschiebelagerantrieb" bogie on S-bahn locomotive (1 page).
German publication describing SLM "Schwenkschiebelagerantrieb" bogie, 1987 (5 pages).
German publication describing SLM Lok 2000 bogie, 1991 (6 pages).
Eisenbahn Journal depicting Siemens Class 1016/1116/1216 and 2016 and production version of SLM "Schwenkschiebelagerantrieb" bogie, 2003 (5 pages).
Engineering schematic depicting bushing from Siemens Class 1016/1116/1216 and 2016 Times Rubber (China) traction rod (1 page).

* cited by examiner

*Primary Examiner* — R. J. McCarry, Jr.

(57) ABSTRACT

A self-steering system for a radial bogie of a railroad vehicle is provided. The self-steering system includes a plurality of links which connect the leading and trailing wheelsets to the bogie frame. Each of the links is adapted to provide a smaller degree of movement between the link and the wheelset at one end and a larger degree of movement between the link and the bogie frame at the other end.

25 Claims, 13 Drawing Sheets

SELF-STEERING RADIAL BOGIE

CROSS-REFERENCE TO RELATED APPLICATIONS

This application claims benefit under 35 U.S.C. §119(e) of U.S. Provisional Application Ser. No. 61/081,237, entitled "Self-Steering Radial Bogie," filed Jul. 16, 2008, naming Hans-Dieter Schaller and Xiaoying Ma as inventors, the complete disclosure thereof being incorporated herein by reference.

FIELD OF THE INVENTION

The present invention relates generally to railroad vehicles and particularly to self-steering radial bogies for railroad vehicles.

BACKGROUND OF THE INVENTION

Radial bogies generally provide railroad vehicles (e.g., unpowered railroad cars and locomotives with motorized axles) the ability to negotiate tight curves through radial adjustment of their wheelsets. The radial adjustment of wheelsets for curve negotiation is generally effected by the longitudinal forces that arise at contact surface points of the wheels as they travel around curves. Such radial adjustability is generally proposed to reduce friction and wear of the wheels and rails by minimizing lateral creep forces.

Traditional radial bogies include a linkage mechanism for providing steering interconnection of the wheelsets. For example, U.S. Pat. No. 6,871,598, incorporated by reference herein and made a part hereof, provides a radial bogie arrangement including an inter-axle link or guide rod which couples the rotation of the steering beam for the leading wheel set with the steering beam of the trailing wheel set. Nevertheless, these steering linkage mechanisms add significant weight and cost to the radial bogie arrangement. Accordingly, it is an object of the present invention to provide a radial bogie arrangement which does not necessitate the use of a steering linkage mechanism.

This and other desired benefits of the preferred embodiments, including combinations of features thereof, of the invention will become apparent from the following description. It will be understood, however, that an arrangement could still appropriate the claimed invention without accomplishing each and every one of these desired benefits, including those gleaned from the following description. The appended claims, not these desired benefits, define the subject matter of the invention. Any and all benefits are derived from the multiple embodiments of the invention, not necessarily the invention in general.

SUMMARY OF THE INVENTION

Provided is a self-steering system for a radial bogie of a railroad vehicle. The self-steering system generally includes a plurality of links which connect the leading and trailing wheelsets to the bogie frame. Each of the links is adapted to provide a smaller degree of movement between the link and the wheelset at one end and a larger degree of movement between the link and the bogie frame at the other end. This arrangement provides radial adjustment of the wheelsets during turns. In one embodiment, each of the leading and trailing wheelsets is connected to the bogie frame via a plurality of such links.

The smaller degree of movement is generally achieved by using a relatively stiff bushing situated at one end of the link. The larger degree of movement is generally achieved by using a relatively soft or resilient bushing at the other end of the link. The relatively soft or resilient bushing at the other end of the link may have a progressive longitudinal stiffness over a range of displacement or deflection values. Moreover, the relatively soft or resilient bushing at the other end of the link may have a relatively high vertical stiffness to transfer the vertical component of damper force.

In another embodiment, the self-steering system further includes a damper situated between the second end of the link and the frame of the bogie. The damper provides greater steering efficiency and high stability. In one arrangement, the damper is coupled to the second end of the link.

In yet another embodiment, the self-steering system further includes a link situated between the longitudinally extending side members of the frame. The link connects one of the wheelsets to the frame of the bogie. In one embodiment, the link may be centrally located such that traction and braking forces are transmitted through the centrally arranged traction link, thereby providing a rotational degree of freedom that does not change significantly with traction or braking forces.

Those skilled in the art will appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention. Also, some parts of the figures are shown in phantom and other parts removed for conveniences of illustration.

DESCRIPTION OF THE PREFERRED EMBODIMENTS

The present invention may be embodied in rail trucks or bogies having at least two or more axles or, otherwise, in railroad vehicles having at least two or more powered or unpowered wheel sets. The present invention may further be incorporated in any railroad vehicle (e.g., locomotives or non-driven railroad vehicles).

Figure 1:
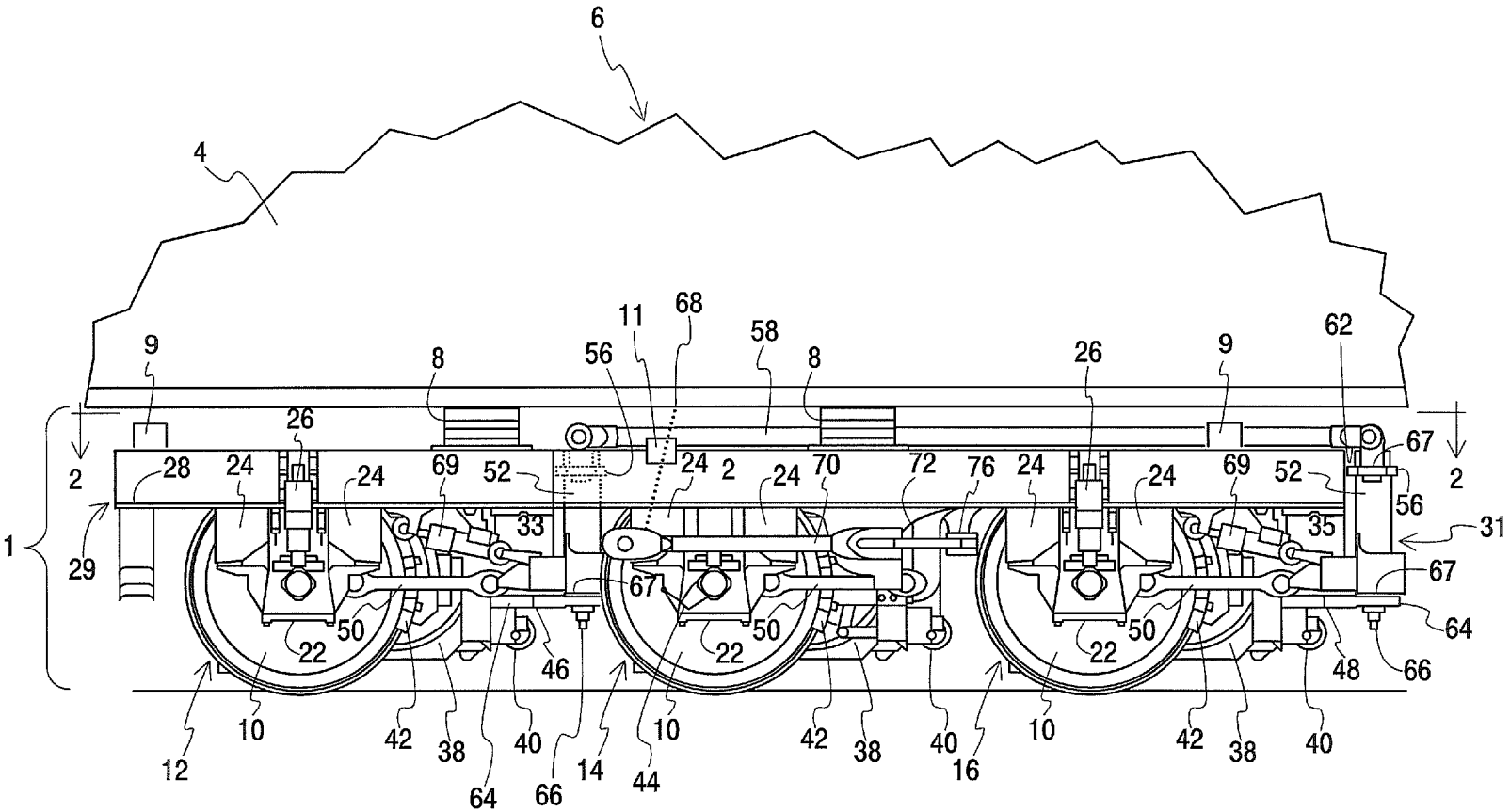
Fig. 1 Prior Art
FIG. 1 is a fragmentary, diagrammatic, side-elevational view of a prior art running gear for rail vehicles with radial adjustability
Figure 2:
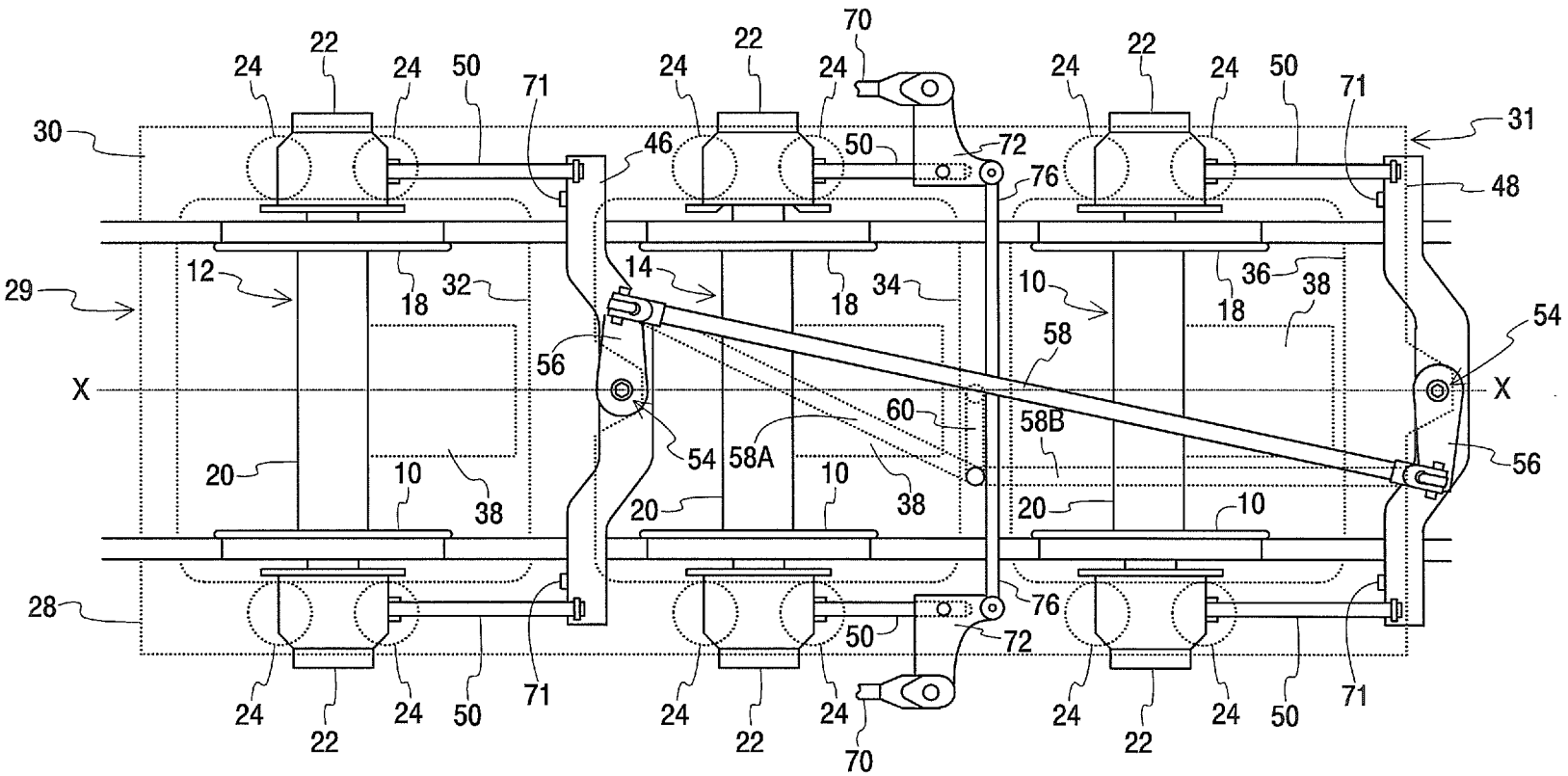
Fig. 2 Prior Art
FIG. 2 is a diagrammatic, top-plan view of the prior art running gear of FIG. 2 in the "straight-ahead" position.
Figure 3:
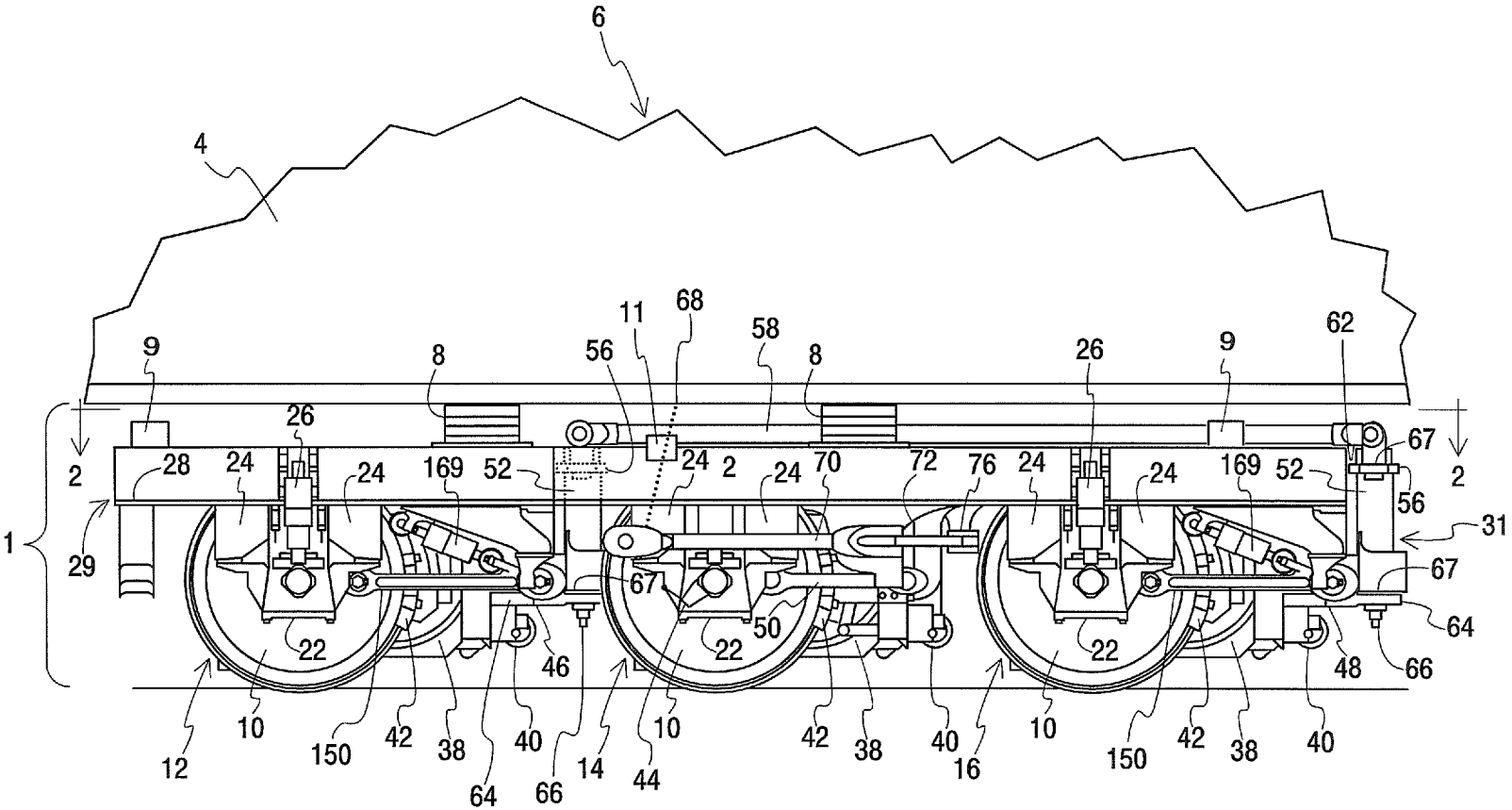
FIG. 3 is a fragmentary, diagrammatic, side-elevational view of a running gear for rail vehicles with radial adjustability in accordance with an embodiment of the present invention.
Figure 4:
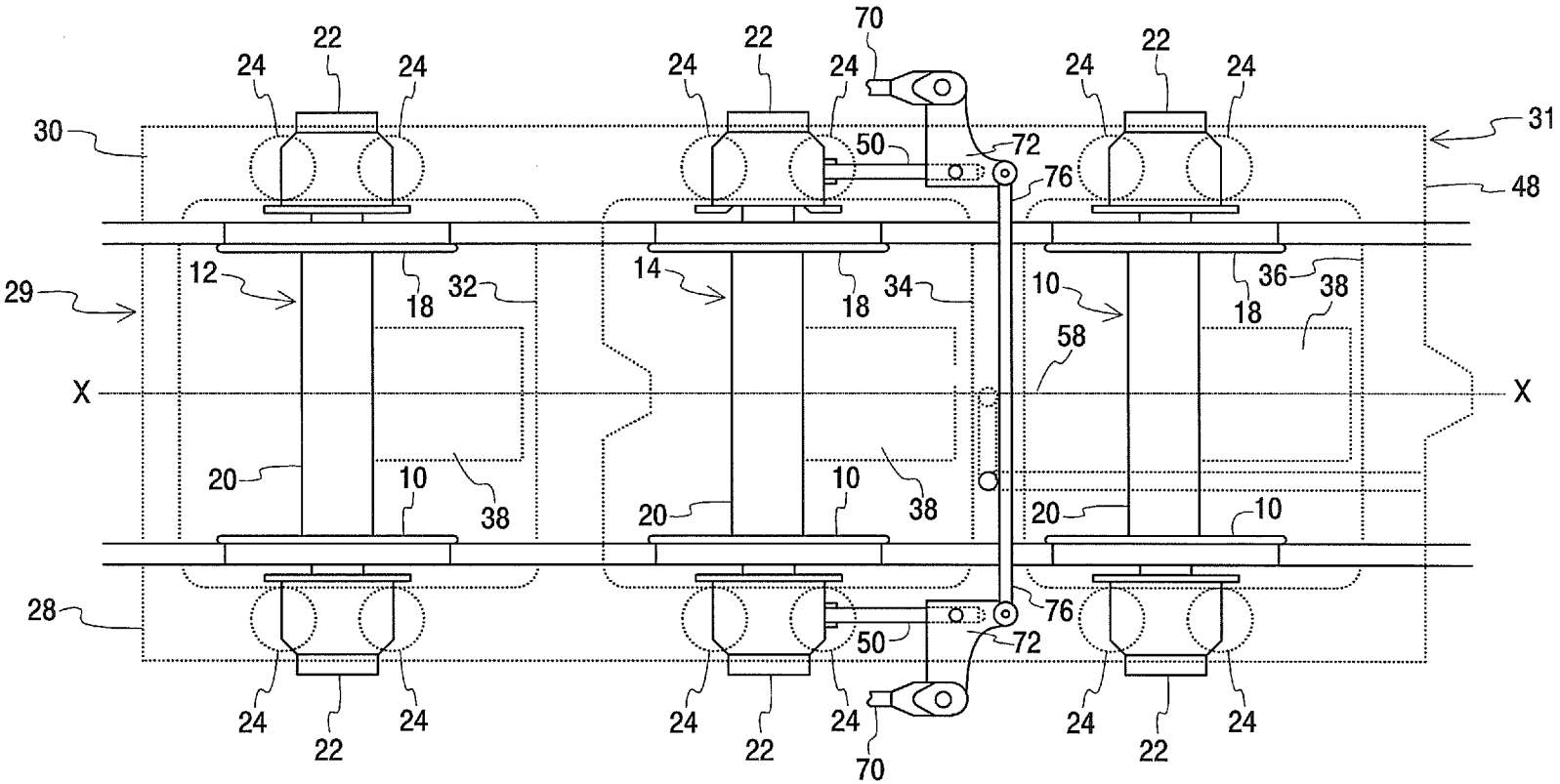
FIG. 4 is a diagrammatic, top-plan view of the running gear of FIG. 3 in the "straight-ahead" position.

Referring now to the figures of the drawing in detail and first, particularly, to FIGS. 1 and 2 thereof, illustrated is a prior art running gear or undercarriage, generally indicated as 1, for a railroad vehicle with radial adjustability. The running gear 1 includes at least one truck frame or bogie 2, which elastically supports a carbody 4 of a railroad vehicle, generally indicated by numeral 6. In one embodiment, the railroad vehicle 6 is a self-powered railroad locomotive having the carbody 4 supported by at least two motorized self-steering bogies 2 (only one of which is shown) having two or more wheelsets. In another embodiment, the railroad vehicle 6 may be an unpowered railroad car having the carbody 4 supported by at least two or more self-steering bogies 2 having two or more wheelsets. In another embodiment (not shown), the self-steering bogie 2 may be situated between a first and second carbody. This arrangement is commonly referred to as an articulated vehicle.

Spring elements 8 are provided along the top of the bogie to provide suspension and support for the carbody 4. The spring elements 8 may be either stiff or soft depending on the amount of suspension and support desired for the carbody 4. In one example, the spring elements 8, which could be replaced by any other suitable resilient suspension apparatus, may have a high compression stiffness to provide a relatively stiff secondary suspension between the truck frame and carbody. In another embodiment, the spring elements 8 may yield more freely in shear to permit limited lateral motion as well as yawing motion of the bogie relative to the carbody 4 during normal curve negotiation. Carbody stops 9, provided also along the top of the bogie 2, are arranged to engage inner portions of the carbody 4 to limit the amount of carbody yaw motion as required. Additionally, lateral stops 11 are provided on the bogie 2 to limit the amount of carbody lateral motion as required.

In the illustrated embodiment, elastically suspended from the bogie 2 are a first wheelset 12, a second wheelset 14, and a third wheelset 16. Each wheelset 12, 14, and 16 comprises a first rail engageable wheel 10 and a second rail engageable wheel 18. Left and right wheels 10 and 18 of each wheelset 12, 14, and 16 are support by an axle 20 and are generally parallel and laterally spaced from each other. Additionally, the wheelsets 12, 14, and 16 are also laterally spaced to form longitudinally spaced wheel and axle assemblies. A bearing housing 22 rotatably supports each end of the axle 20 and elastically supports the bogie 2 through wheelset spring elements 24.

The bearing housing 22 may be either a one-piece or a two-piece design. In the one-piece design, the bearing housing 22 is a single piece that encloses the bearing assembly totally (not shown). In the two-piece design, the bearing housing 22 includes upper and lower housing parts. The upper housing provides the interface to the bearing assembly and transfers vertical and horizontal loads. The lower part, or bearing cap/retainer, provides the means of lifting the wheelset with the bearing housing and adds structural strength to the whole assembly.

The wheelset spring elements 24 allow limited relative motion of the wheelsets 12, 14, and 16 with their bearing housings 22 while resiliently urging the housings and their wheel and axle assemblies into nominally centered non-curving longitudinally aligned positions, as is illustrated in FIG. 2. A wheelset-damping element 26 may also be provided between the bogie 2 and each bearing housing 22 (only two of which are shown) for further suspension.

The bogie 2 may be a unitary or assembled/joined frame, and fabricated, cast, or otherwise manufactured. In particular, the bogie 2 includes a pair of generally parallel, laterally-spaced, longitudinally-extending side frames 28 and 30, which for convenience of illustration are shown in dashed lines in FIG. 2, along with other hereafter-mentioned frame members. The side frames 28 and 30 define a longitudinal axis x, which extends an equal distance therebetween, and have leading and trailing ends 29 and 31. Side frames 28 and 30 are interconnected by longitudinally-spaced, transversely-extending transoms, which in the illustrated embodiment are transoms 32, 34, and 36. A pair of posts 33 and 35 depend from center and trailing transom 34 and 36, respectively, one of each pair is only shown.

For powering the wheelsets to drive the locomotive embodiment, the bogie 2 is then provided with at least two traction motors 38 or other similar arrangement, one driving each axle 20. In one example as shown, each motor is supported by a conventional bearing arrangement on its respective axle, and is carried from one of the adjacent transoms, via a nose link 40 and/or mounting to respective post 33 or 35. Each nose link 40 is flexibly or swively connected at its ends to allow a limited amount of both longitudinal and lateral motion between the traction motor 38 and the adjacent transom by which it is supported.

Those skilled in the art will recognize that the present bogie arrangements may further include additional components and/or arrangements, such as brakes 42, speed recorder 44, other additional suspension members such as, for example, secondary lateral and yaw dampers, lateral and yaw stops, pitching stops and dampers, and components such as, for example, sand boxes and steps, air ducts, and additional transoms. Such components and others are further disclosed by commonly assigned U.S. Pat. Nos. 4,628,824; 4,679,506; 4,765,250; 4,841,873; 5,613,44; and 5,746,135, which disclosures are herein incorporated fully by reference.

To provide for limited self-steering action of the wheelsets while transmitting traction and braking forces between the wheel and axle assemblies and the bogie frame, the prior art bogie 2 is provided with a traction linkage formed in accordance with the invention. This traction linkage includes laterally-extending leading and trailing steering beams 46 and 48, respectively, which are pivotally connected at their centers with the bottoms of adjacent transoms 32 and 36, respectively. The steering beams 46 and 48 allow the rotation of the end wheelsets relative to the bogie frame.

Laterally opposite ends of the leading and trailing steering beams 46 and 48, respectively, are connected with the bearing housings 22 of the leading and trailing wheelsets 12 and 16 by traction links 50. The steering beams 46 and 48 are attached to upstanding torque tubes 52 which extend vertically upward about a pivot axis 54 of the steering beams and connect, at their upper ends, with a respective one of a pair of crank arms 56. These crank arms 56 extend in laterally opposite directions. The ends of the crank arms 56 are interconnected by an inter-axle link 58 which extends diagonally therebetween over the wheelsets 14 and 16 and the transom 34. In one embodiment, the link 58 may be a unitary component, and in another embodiment illustrated in dashed lines, the link 58 may be segmented or of a split design having first and second links 58*a* and 58*b*, which are pivotably supported from the transom 34 by lever arm 60. It is to be appreciated that first and second links 58*a* and 58*b* have the same effective length such that the end axles of the leading and trailing wheelsets rotate the same amount.

To support the leading and trailing steering beams 46 and 48 with their associated torque tubes 52 and crank arms 56, the adjacent transoms 32 and 36 are provided with upper pivot plates 62. At the ends of each pair of posts 33 and 35 provided is a lower pivot plate 64, such that the upper and lower pivot plates carrying through bolts 66. Bolts 66 secure bushings 67 on which the torque tubes 52 are pivotally mounted. It is to be appreciated that the traction links are as long as possible to reduce the angular loading on the bushings 67 from respective wheelsets movement in the vertical and lateral directions relative to the bogie frame. Lower angular loading increases life expectancy, reliability, and reduces the contribution of each traction link 50 to the lateral and vertical stiffness of the bogie frame.

The steering beams 46 and 48, traction links 50, cranks 56, and inter-axle link 58 are so arranged as to require equal and opposite yawing (steering) motions of the leading and trailing wheelsets 12 and 16, respectively, so as to provide efficient inter-related self-steering actions of the end axles. These components comprise a first force transmitting linkage which carry the traction and braking forces between the wheelsets and the bogie frame, as well as allowing equal and opposite self-steering of the end wheelsets 12 and 16.

In the prior art system, a pair of yaw dampers 69 is connected to each steering beam 46 and 48 and the bogie frame, one of each pair only shown by FIG. 1. The yaw dampers 69 are provided for good steering efficiency and high stability by controlling the rotation of the end wheelsets 12 and 16. Since only the relative motion between the steering beam and the bogie frame is rotation around the vertical axis, this damper location ensures that only the steering mode is damped, and reduces the angular loading of the damper bushings. In another embodiment, further control of the end wheelsets 12 and 16 is provided for by steering beam bumpers 71, which limit the rotation of the steering beams of the end wheel sets 12 and 16. The steering beam bumpers 71 may be either mounted to their respective steering beam 46 and 48 or supported on their respective transom 32 and 36.

Nevertheless, the self-steering arrangement of the prior art system provides undesirable weight and cost. The prior art self-steering (including steering beams 46 and 48, traction links 50, cranks 56, and inter-axle link 58, yaw dampers 69) of FIGS. 1 and 2 may be replaced with various embodiments of the present invention self-steering arrangement as shown in FIGS. 5-12.

More specifically, in one embodiment as shown in FIGS. 3-7, present invention traction links 150 are shown connecting the bearing housings 22 of the leading and trailing wheelsets 12 and 16 to the bogie frame at 32 and 36, respectively. In another embodiment, in order to provide steering efficiency and high stability, yaw dampers 169 are further provided. In contrast to the prior art system, the yaw dampers 169 are shown to connect the traction links 150 to the bogie frame at 28 and 30, rather than connecting each steering beam 46 and 48 to the bogie frame.

Figure 5:
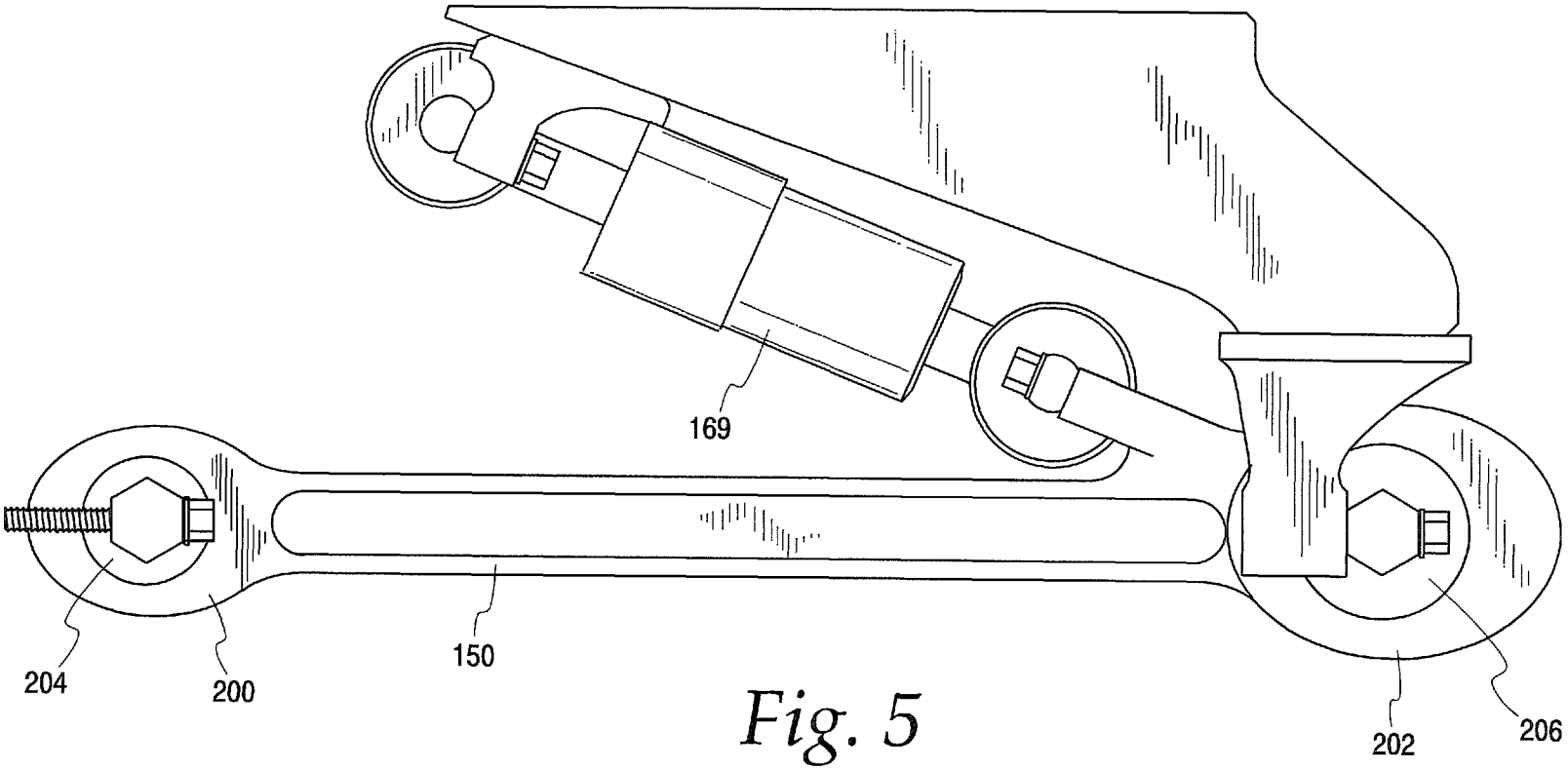
FIG. 5 is a side-elevational view of the new traction link arrangement of FIGS. 3 and 4 in accordance with an embodiment of the present invention.
Figure 6:
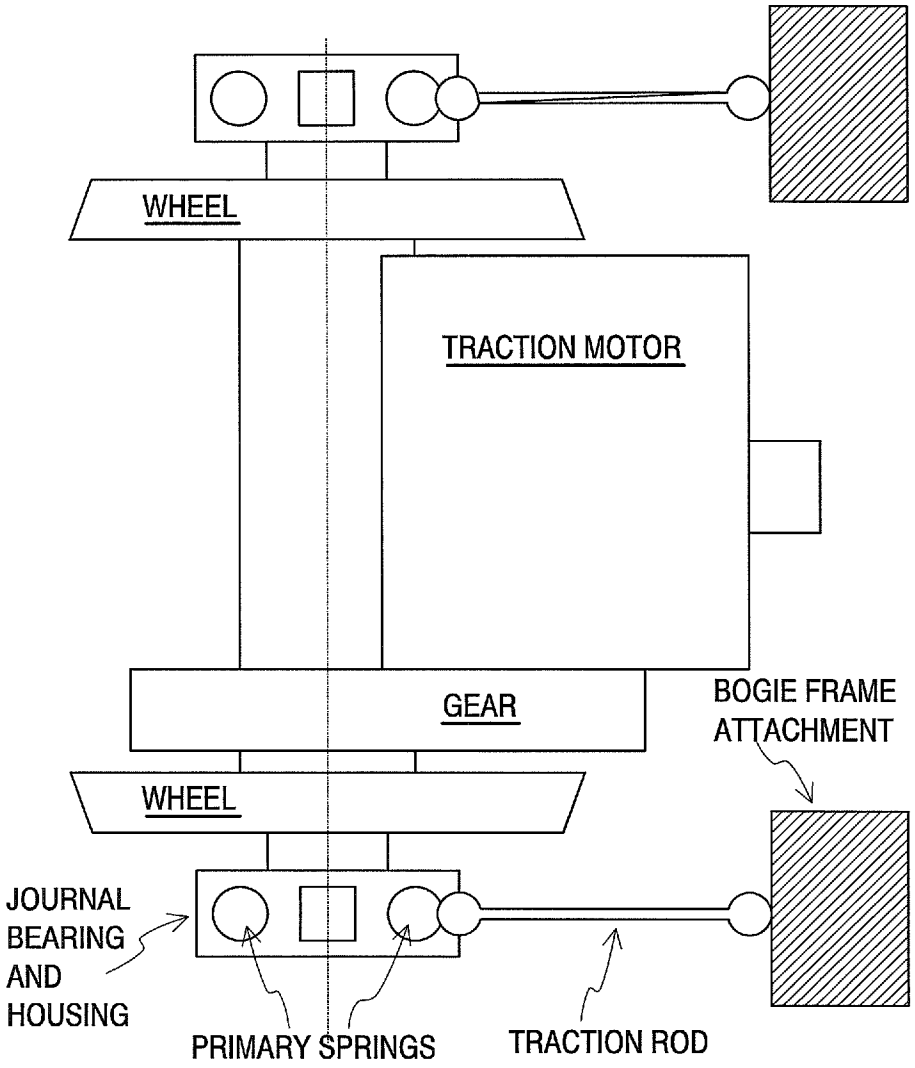
FIG. 6 is a top view, schematic drawing of a conceptual arrangement in accordance with an embodiment of the present invention.

As shown in further detail in FIG. 5, each of the new traction links 150 includes a first end 200 and a second end 202. The first end 200 is generally connected to the bearing housings 22 of the leading and trailing wheelsets 12 and 16. The first end 200 generally includes a relatively stiff bushing 204 which is adapted to provide a smaller degree of movement between the wheelset via the bearing housing 22 and the traction link 150. The bushing 204 at the first end 200 generally has a longitudinal stiffness of at least about 35 kN/mm, and preferably between about 60 kN/mm to about 100 kN/mm. Although the vertical stiffness of the bushing 204 at the first end 200 may be selected at any stiffness, it is preferable that the vertical stiffness is about equal to the longitudinal stiffness.

Figure 13A:
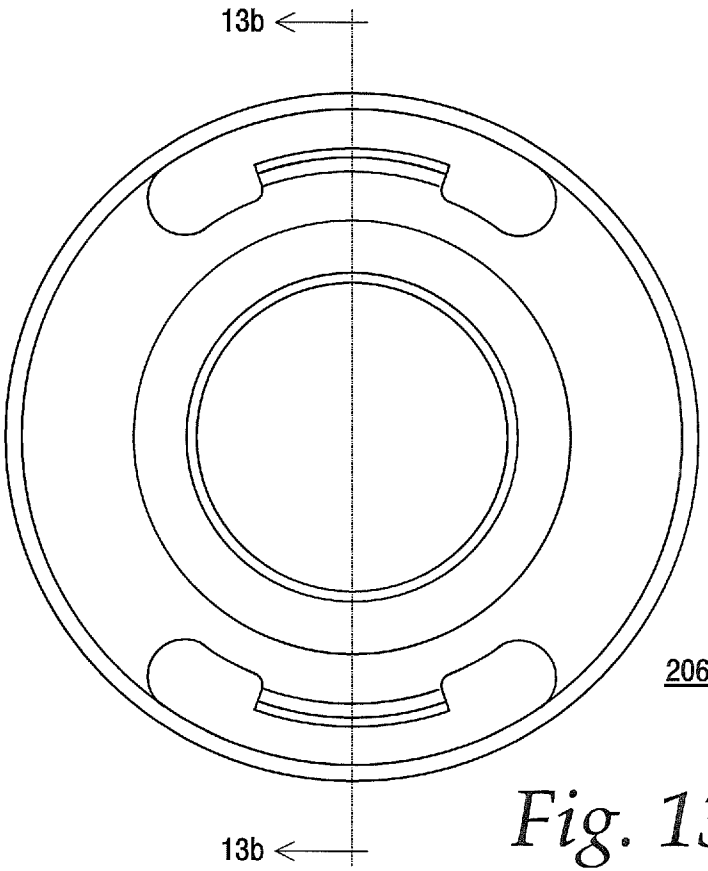
FIG. 13*a-b* are a cross-sectional view and a top view of a bushing suitable for use at the second end of the traction link of FIG. 5.
Figure 13B:
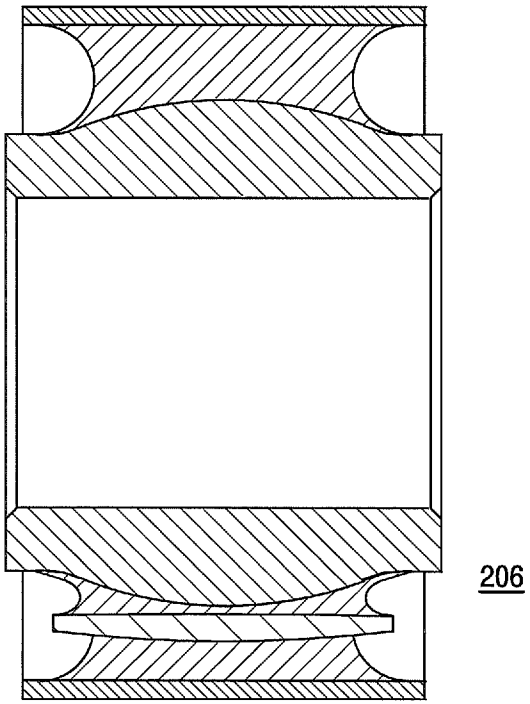

The second end 202 is generally connected to the bogie frame 32, 36. The second end 202 generally includes a relatively soft bushing 206 in the longitudinal direction which is adapted to provide a larger degree of movement between the bogie frame 32, 36 and the traction link 150. An example of a suitable bushing is illustrated in FIG. 13. The bushing 206 at the second end 202 is selected to have a progressive longitudinal stiffness over a range of displacement or deflection values to accommodate self-steering around various sized curves. The force deflection graph for longitudinal displacements of bushing 206 can be divided in 3 zones as shown in FIG. 14.

Depending on the application, Zone A ranges from about −2 to +2 mm or up to about −6 mm to +6 mm longitudinal displacement. In this range, the longitudinal stiffness of bushing 206 may be about 0 kN/mm to about 8 to 10 kN/mm. It is preferable that the longitudinal stiffness is about 2 kN/mm to about 4 kN/mm. In Zone B, the bushing 206 has an exponentially increasing longitudinal stiffness ranging from about 4 kN/mm to about 150 kN/mm depending on the maximum deflection. A very high stiffness is provided in Zone C (not shown) to limit the maximum displacement.

For wheel mounted disk brake application which are not sensitive to longitudinal wheel movements or for conventional tread brake systems having a large application stroke, the maximum displacement range extends up (or down) to about ±10 mm. For unitized tread brake systems having a limited application stroke, the displacement range extends up (or down) to about ±5 mm.

Figure 14:
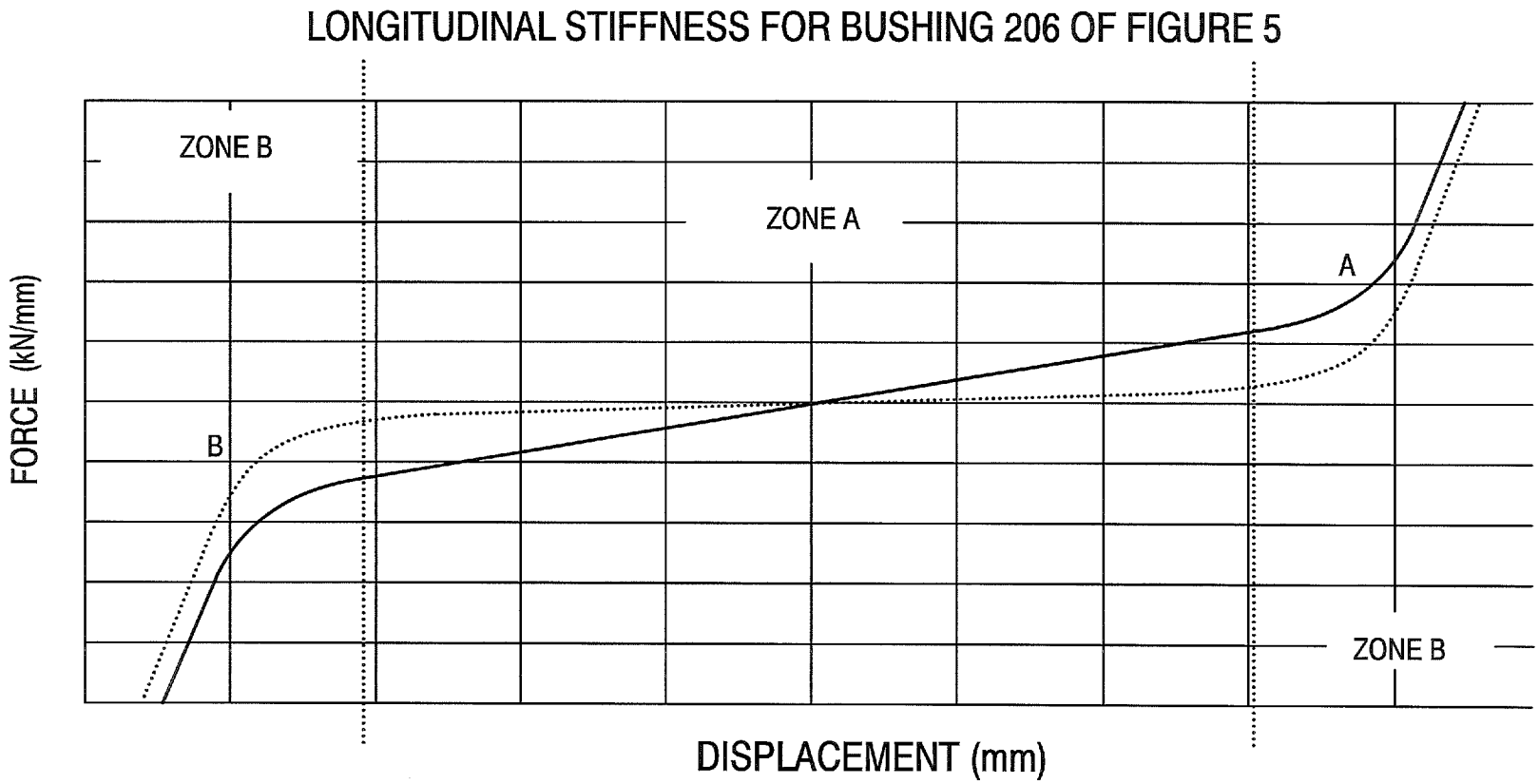
FIG. 14 is a graph depicting the desired longitudinal stiffness of the bushing of FIG. 13*a-b*.

FIG. 14 illustrates force deflection for longitudinal displacements of two are suitable for use with the second end. For bushing A, over the displacement range of about −4 mm to about 4 mm, the bushing 206 has a linearly increasing longitudinal stiffness ranging from about 0 kN/mm to about 6 to 7 kN/mm. Over the displacement range starting at about −4 mm and at about 4 mm, the bushing 206 has an exponentially increasing longitudinal stiffness ranging from about 25 kN/mm to about 150 kN/mm depending on the maximum deflection. For bushing B, over the displacement range of about −4 mm to about 4 mm, the bushing 206 has a linearly increasing longitudinal stiffness ranging from about 0 kN/mm to about 2 kN/mm. Over the displacement range starting at about −4 mm and at about 4 mm, the bushing 206 has an exponentially increasing longitudinal stiffness ranging from about 2 kN/mm to about 150 kN/mm depending on the maximum deflection.

The bushing 206 at the second end 202 may be constructed relatively stiff in the vertical direction to transfer the vertical component of damper force. In one embodiment, the bushing 206 at the second end 202 generally has a vertical stiffness of about 20 kN/mm. This arrangement of a bushing having a progressive longitudinal stiffness over a range of displacement and a relatively stiff vertical stiffness provides radial adjustment of the wheelsets during turns. For example, for 3-axle standard gauge bogies (e.g., in North America, Europe, China, etc.) and an axle spacing of around 4000 mm, this arrangement will enhance the self-steering to curves as tight as 500 m to 800 m.

Figure 11:
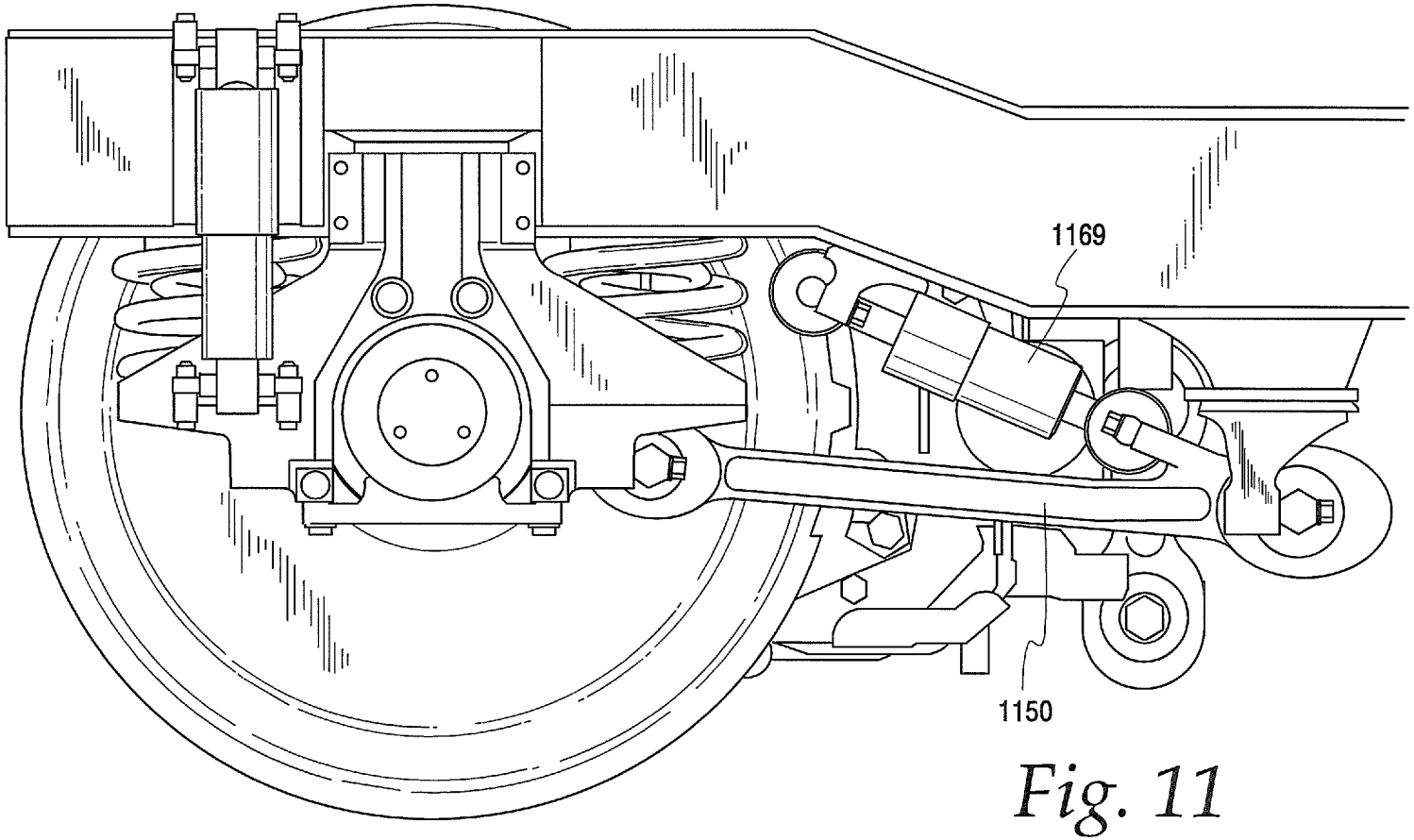
FIG. 11 is a side-elevational view of the new traction link arrangement in accordance with an embodiment of the present invention.

It is to be noted that the bushings 204, 206 may be constructed of any suitable resilient material (e.g., a rubber, polymer, etc.). It is also to be noted that the first end 200 and second end 202 of the traction link 150 may be directly or indirectly connected to any structure coupled to the wheel set or the bogie frame, respectively. Although the traction link 150 is shown to be generally straight in FIG. 5, the traction link 1150 may also include a curvature as shown in FIG. 11. This curvature may facilitate the placement of the traction link 1150 in the bogie system or may be otherwise be adapted to change the stiffness value of the traction link itself.

Figure 12:
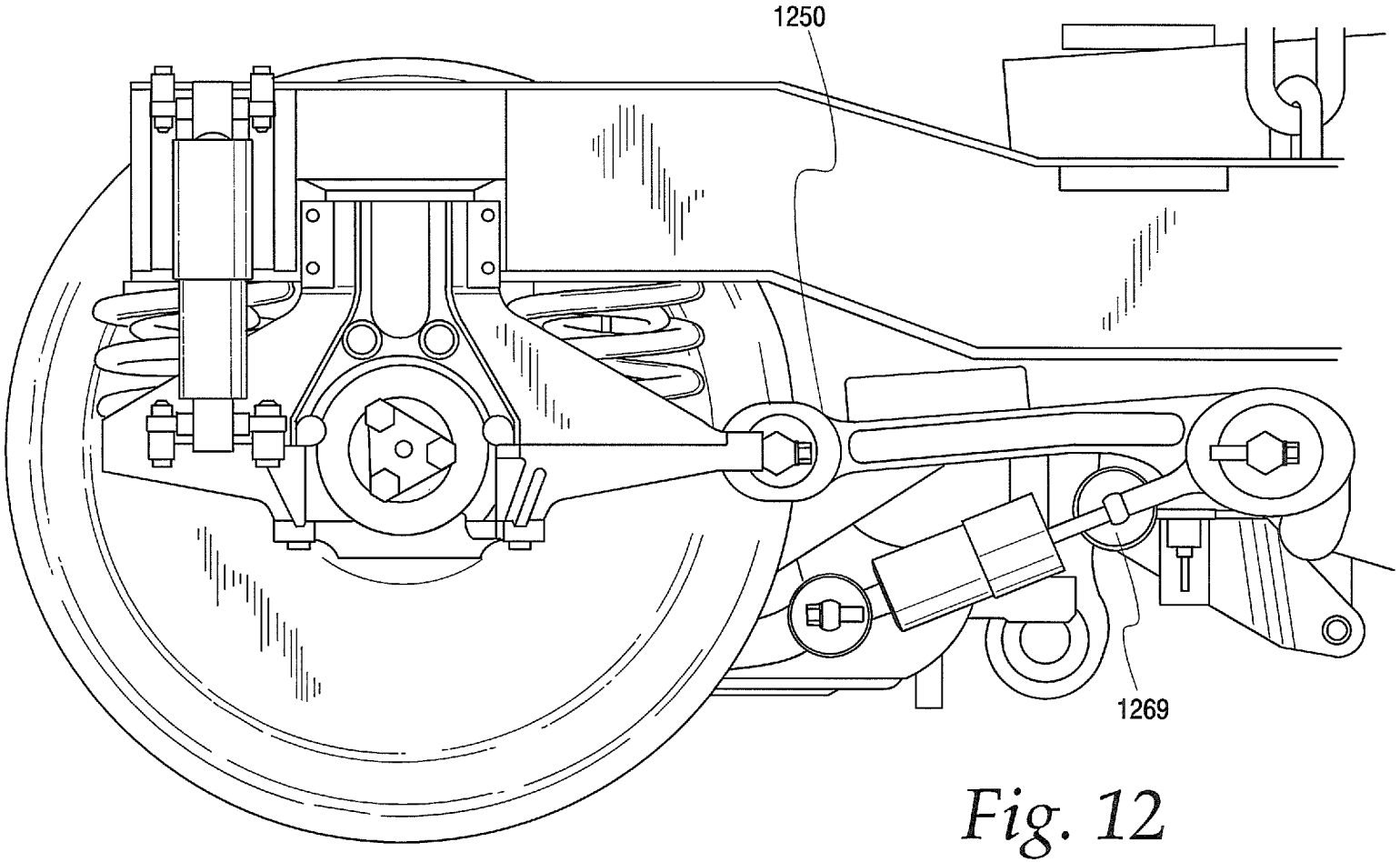
FIG. 12 is a side-elevational view of the new traction link arrangement in accordance with an embodiment of the present invention.

As further illustrated in FIG. 5, a yaw damper 169 may be coupled with each traction link 150 to provide greater steering efficiency and high stability. The yaw damper 169 is shown to connect the traction link 150 to the bogie frame 28, 30. More specifically, the yaw damper 169 is connected to the traction link 150 near the second end 202 which includes the relatively soft bushing 206. In this arrangement, the yaw damper 169 dampens high-frequency oscillatory yaw movement of the wheel set, while not adding resistance to the low-frequency quasi-static wheel set rotation when negotiating turns. This damper location further ensures that only the steering mode is damped, and reduces the angular loading of the damper bushings. Although the yaw damper 169 is shown to be generally situated above the traction link 150 in FIG. 5, the yaw damper 1269 may also be generally situated below the traction link 1250 as shown in FIG. 12 without deviating from the teachings of the present invention.

Figures 7, 9:
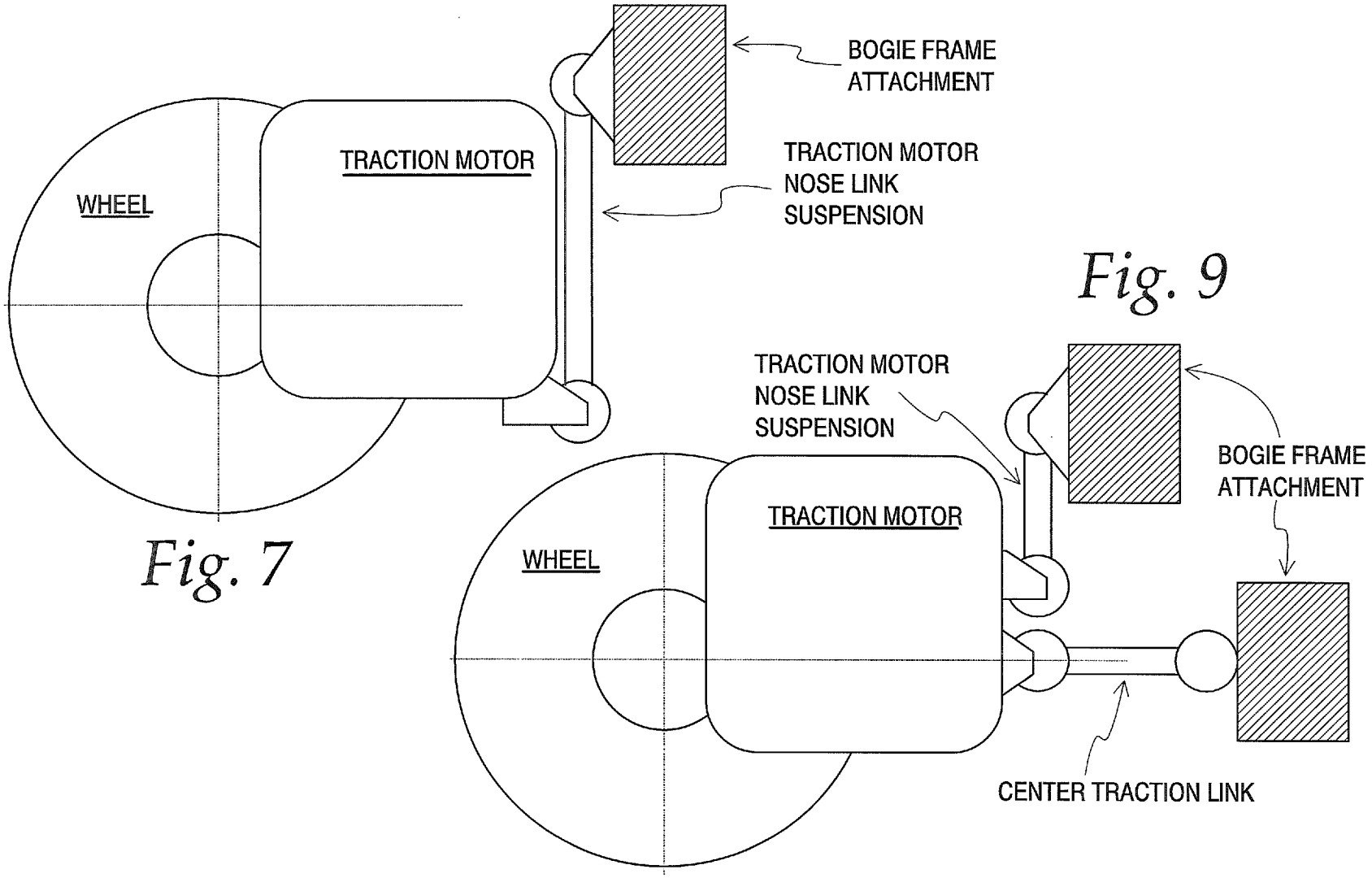
FIG. 7 is a sectional view, schematic drawing of the conceptual arrangement of FIG. 6.
FIG. 9 is a side view, schematic drawing of the conceptual arrangement of FIG. 8.
Figure 8:
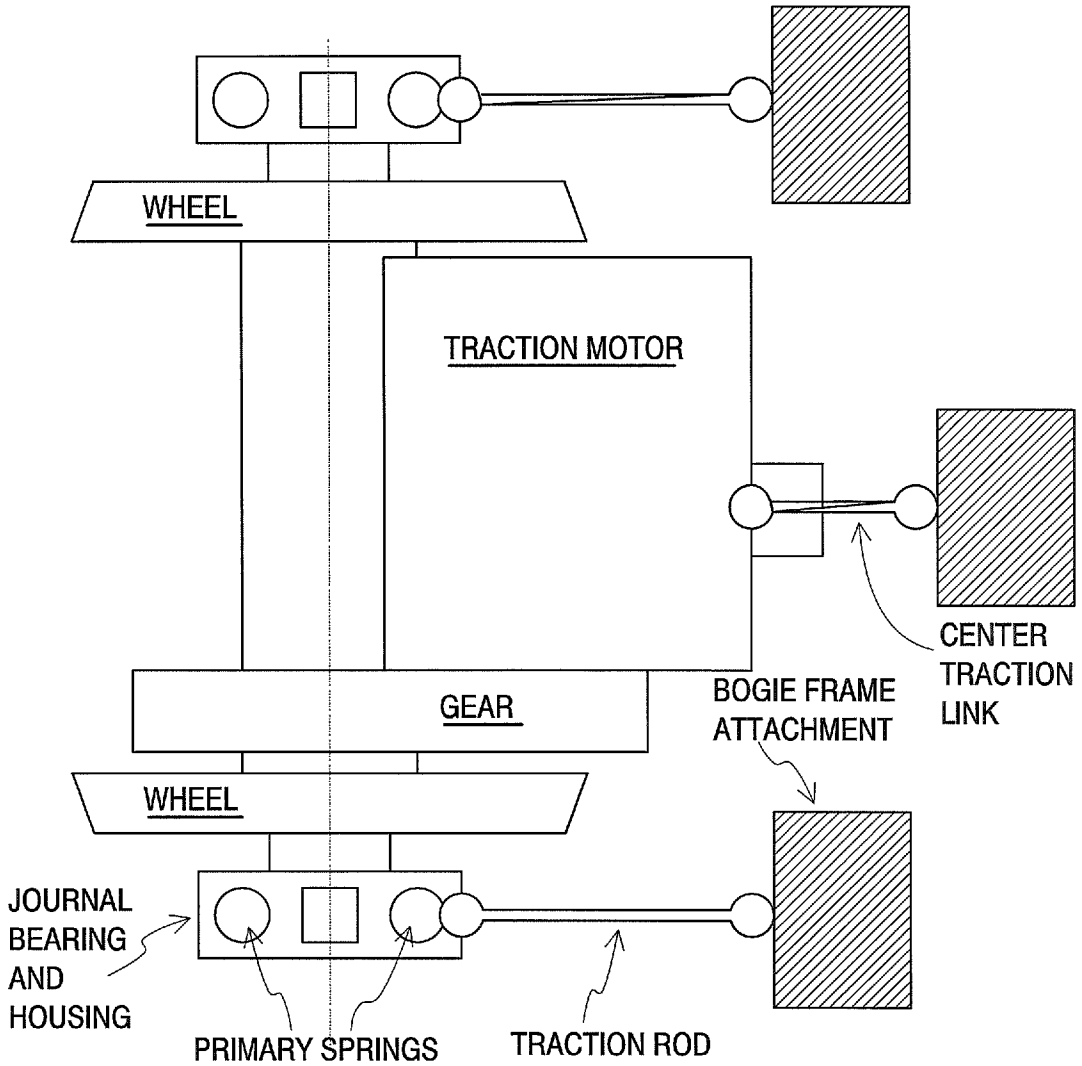
FIG. 8 is a top view, schematic drawing of the conceptual arrangement in accordance with an embodiment of the present invention.

In yet another embodiment as shown in FIGS. 8 and 9, centrally arranged traction links 300 may additionally be provided to connect the bogie frame at 32, 36 to a structure coupled to the leading and trailing wheelsets 12 and 16, respectively. In this arrangement, traction and braking forces are transmitted through the centrally arranged traction link 300, thereby providing a rotational degree of freedom that does not change significantly with traction or braking forces.

Figure 10:
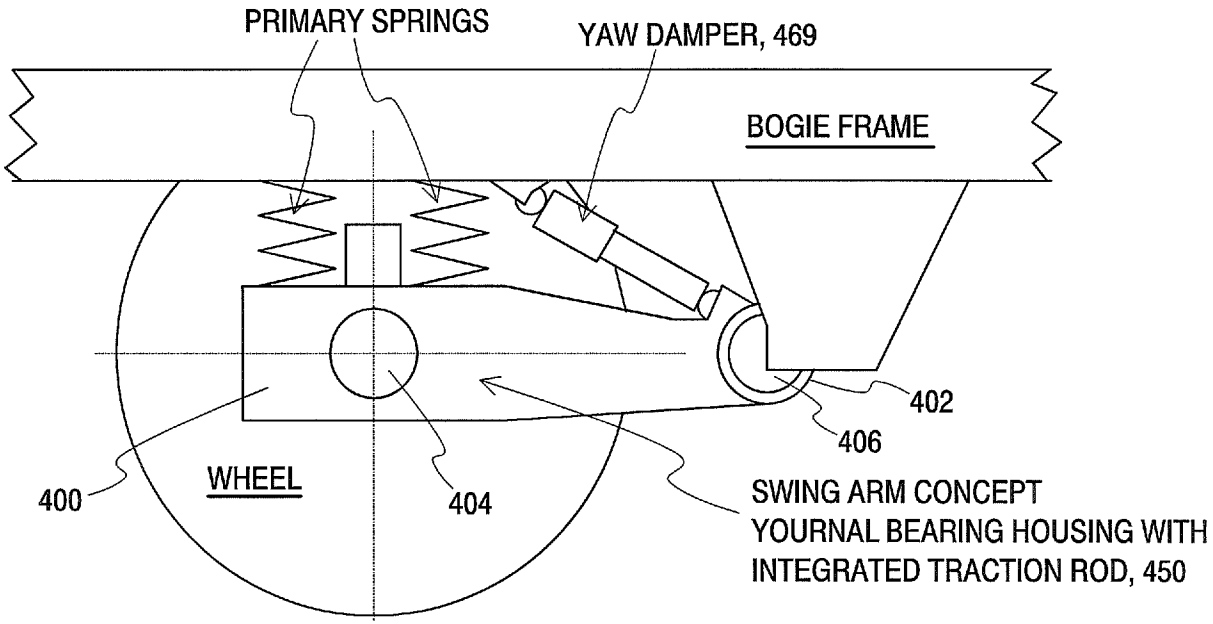
FIG. 10 is a side view, schematic drawing of the conceptual arrangement in accordance with an embodiment of the present invention.

In yet another embodiment as shown in FIG. 10, the new traction link may be combined with the journal bearing housing to form a swing-arm apparatus 450. In this arrangement, the present invention swing-arm 450 may be adapted to connect the leading and trailing wheelsets 12 and 16 to the bogie frame at 32 and 36, respectively. The swing-arm apparatus 450 includes a first end 400 and a second end 402. The first end 400 is connected generally directly connected to the leading and trailing wheelsets 12 and 16. The first end 400 generally includes a stiff journal bearing 404, or otherwise a relatively stiff bushing, which is adapted to provide a smaller degree of movement between the wheelset 12, 16 and the swing-arm apparatus 450. The second end 402 is generally connected to the bogie frame 32, 36. The second end 402 generally includes a relatively soft bushing 406 which is adapted to provide a larger degree of movement between the bogie frame 32, 36 and the swing-arm apparatus 450. This arrangement provides radial adjustment of the wheelsets during turns. It is to be noted that the bushings 404, 406 may be constructed of any suitable resilient material (e.g., a rubber, polymer, etc.). It is also to be noted that the first end 400 and the second end 402 of the swing-arm apparatus 450 may be directly or indirectly connected to any structure coupled to the wheel set or the bogie frame, respectively.

In another embodiment, in order to provide steering efficiency and high stability, yaw dampers 469 are further provided. In contrast to the prior art system, the yaw dampers 469 are shown to connect the swing-arm apparatus 450 to the bogie frame at 28 and 30.

As discussed with regards to the various embodiments of the present invention, one end of the traction link is connected to one of the wheelsets to provide a smaller degree of movement therebetween, whereas the other end of the traction link is connected to the frame of the bogie to provide a larger degree of movement therebetween. This may be achieved using various arrangements including, but not limited to the use of bushings. For example, a stiffer bushing may be used in conjunction with the end of the traction link connected to the wheelset, whereas a softer bushing may be used in conjunction with the other end of the traction link connected to the frame of the bogie. Moreover, the stiffness of the traction link itself may be adapted to achieve the teachings of the present invention.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

The invention claimed is:

1. A self-steering system for a radial bogie of a railroad vehicle, the radial bogie having a frame with longitudinally extending side members laterally spaced by transoms and leading and trailing ends, the radial bogie further including a leading and trailing wheelset supported on said frame, said self-steering system comprising:

a damper connected to the frame of the bogie;

a link having a first and second end, the first end of the link connected to one of the wheelsets, the second end of the link connected to:

the frame of the bogie at a first position of the second end, and the damper at a second position of the second end;

the first end of the link including a first bushing; and the second end of the link including a second bushing, the first bushing having a longitudinal stiffness different than the longitudinal stiffness of the second bushing.

2. The self-steering system of claim 1 further comprising another link situated between the longitudinally extending side members of the frame, said other link connecting one of the wheelsets to a transverse end of the frame of the bogie.

3. The self-steering system of claim 1 wherein the first end of the link includes a journal housing for engaging the wheelset.

4. The self-steering system of claim 1 wherein the first bushing has a longitudinal stiffness of at least 35 kN/mm.

5. The self-steering system of claim 1 wherein the first bushing has a longitudinal stiffness of about 60 kN/mm to about 100 kN/mm.

6. The self-steering system of claim 1 wherein the first bushing has a vertical stiffness of at least 35 kN/mm.

7. The self-steering system of claim 1, wherein the second bushing includes a resilient material.

8. The self-steering system of claim 1, wherein the second bushing includes either a polymer or rubber.

9. The self-steering system of claim 1, wherein the second bushing has a progressive longitudinal stiffness over a range of displacement values.

10. The self-steering system of claim 9, wherein the second bushing has a linearly increasing longitudinal stiffness ranging from about 0 kN/mm to about 7 kN/mm over displacement range of about −4 mm to about 4 mm.

11. The self-steering system of claim 10, wherein the second bushing has a linearly increasing longitudinal stiffness ranging from about 2 kN/mm to about 4 kN/mm over displacement range of about 2 mm to about 4 mm.

12. The self-steering system of claim 10, wherein the second bushing has a linearly increasing longitudinal stiffness ranging from about 2 kN/mm to about 4 kN/mm over displacement range of about −2 mm to about −4 mm.

13. The self-steering system of claim 9, wherein the second bushing has an exponentially increasing longitudinal stiffness ranging from about 4 kN/mm to about 150 kN/mm over displacement range starting at about −4 mm.

14. The self-steering system of claim 9, wherein the second bushing has an exponentially increasing longitudinal stiffness ranging from about 4 kN/mm to about 150 kN/mm over displacement range starting at about 4 mm.

15. The self-steering system of claim 1, wherein the second bushing has a vertical stiffness of about 20 kN/mm.

16. The self-steering system of claim 1, wherein the link is a traction link.

17. A radial bogie for a railroad vehicle, comprising:

a frame with longitudinally extending side members laterally spaced by transoms and leading and trailing ends;

a leading and trailing wheelset supported on said frame, and a plurality of links situated between each wheelset and the frame, each link having a first and second end, the first end of each link connected to one of the wheelsets and the second end of each link connected to the frame of the bogie;

the first end of each link including a first bushing; and the second end of each link including a second bushing, the first bushing having a longitudinal stiffness greater than the longitudinal stiffness of the second bushing; and a damper connected to the frame and to the second end of one of the links, a longitudinal axis of the damper extending through the second bushing of one of the links.

18. The radial bogie of claim 17, wherein each wheelset is connected to the frame by at least two links.

19. The radial bogie of claim 17, wherein the damper is one of a plurality of dampers, each damper being situated between the second end of one of the links and the frame of the bogie.

20. The radial bogie of claim 17 wherein the links are situated near the longitudinally extending side members of the frame.

21. The radial bogie of claim 17 further comprising another link situated between the longitudinally extending side members, said other link connecting one of the wheelsets to a transverse end of the frame of the bogie.

22. The radial bogie of claim 17, wherein the second bushing includes a resilient material.

23. The radial bogie of claim 17, wherein the second end of each link is connected to the frame at a first position of the second end and to the damper at a second position of the second end.

24. The radial bogie of claim 23, wherein the damper connects the second end of one of the links to the frame without a steering beam.

25. A radial bogie for a railroad vehicle, comprising:

a frame with longitudinally extending side members laterally spaced by transoms and leading and trailing ends;

a leading and trailing wheelset supported on said frame, and a plurality of links situated between each wheelset and the frame, each link having a first and second end, the first end of each link connected to one of the wheelsets and the second end of each link connected to a fixed portion of the frame of the bogie so that there is a smaller degree of movement between the wheelset and the first end of each link compared to the amount of movement between the frame of the bogie and the second end of each link; and a damper connecting the second end of one of the links to the frame without a steering beam.

* * * * *